United States Patent [19]

Kavesh et al.

[11] Patent Number: 4,819,458

[45] Date of Patent: Apr. 11, 1989

[54] HEAT SHRUNK FABRICS PROVIDED FROM ULTRA-HIGH TENACITY AND MODULUS FIBERS AND METHODS FOR PRODUCING SAME

[75] Inventors: Sheldon Kavesh, Whippany; Dusan C. Prevorsek; Gary A. Harpell, both of Morristown, all of N.J.

[73] Assignee: Allied-Signal Inc., Morris Township, Morris County, N.J.

[21] Appl. No.: 429,942

[22] Filed: Sep. 30, 1982

[51] Int. Cl.[4] ..... D04B 1/16; D04B 21/16; D03D 15/00; D06C 7/02

[52] U.S. Cl. ..... 66/202; 28/166; 28/167; 139/420 R; 428/902

[58] Field of Search ..... 28/167, 166; 66/202; 428/902; 57/243, 902; 139/420 R

[56] References Cited

U.S. PATENT DOCUMENTS

| | | | |
|---|---|---|---|
| 3,021,588 | 2/1962 | Bolinger et al. . | |
| 3,303,169 | 2/1967 | Pitzl | 57/243 X |
| 3,448,573 | 6/1969 | Glen et al. | 57/243 X |
| 3,748,844 | 7/1973 | Pacofsky | 66/202 UX |
| 4,137,394 | 1/1979 | Meihuizen et al. . | |
| 4,143,197 | 3/1979 | Jasianowicz et al. | 28/167 X |
| 4,344,908 | 8/1982 | Smith et al. . | |
| 4,356,138 | 10/1982 | Kavesh et al. . | |
| 4,403,012 | 9/1983 | Harpell et al. . | |
| 4,413,110 | 11/1983 | Kavesh et al. . | |
| 4,422,993 | 12/1983 | Smith et al. . | |
| 4,430,383 | 2/1984 | Smith et al. . | |
| 4,436,689 | 3/1984 | Smith et al. . | |

FOREIGN PATENT DOCUMENTS

| | | | |
|---|---|---|---|
| 173426 | 12/1952 | Austria . | |
| 1136033 | 12/1968 | United Kingdom | 66/202 |
| 2042414 | 9/1980 | United Kingdom . | |
| 2051667 | 1/1981 | United Kingdom . | |

OTHER PUBLICATIONS

Mead & Porter, "The Preparation and Tensile Properties of Polyethylene Composites", J. Appl. Polymer Science, vol. 22, No. 11 (1978), pp. 3249-3265.

*Primary Examiner*—Robert R. Mackey
*Attorney, Agent, or Firm*—Richard A. Negin

[57] ABSTRACT

Ultrahigh molecular weight polyethylene fibers of high tenacity and modulus shrink controlled amounts at temperatures in the range of 100°-145° C. Fabrics and twisted multifilament yarns of these fibers are heat-shrunk or heat-set at these temperatures.

10 Claims, 1 Drawing Sheet

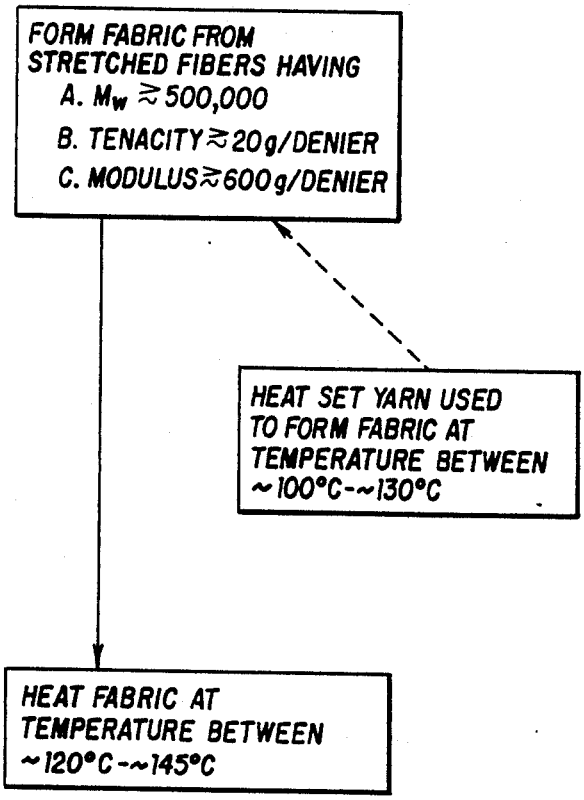
FORM FABRIC FROM
STRETCHED FIBERS HAVING
A. $M_w \gtrsim 500,000$
B. TENACITY $\gtrsim$ 20g/DENIER
C. MODULUS $\gtrsim$ 600g/DENIER
HEAT SET YARN USED
TO FORM FABRIC AT
TEMPERATURE BETWEEN
~100°C-~130°C
HEAT FABRIC AT
TEMPERATURE BETWEEN
~120°C-~145°C

HEAT SHRUNK FABRICS PROVIDED FROM ULTRA-HIGH TENACITY AND MODULUS FIBERS AND METHODS FOR PRODUCING SAME

CROSS-REFERENCE TO RELATED APPLICATIONS

This application is related to the following copending, commonly assigned application filed Mar. 19, 1982:

1. U.S. Ser. No. 359,019 of Kavesh & Prevorsek entitled, "High Tenacity, High Modulus Polyethylene And Polypropylene Fibers And Intermediates Therefore", now U.S. Pat. No. 4,413,110, issued Nov. 1, 1983.
2. U.S. Ser. No. 359,020 of Kavesh & Prevorsek entitled, "Producing High Tenacity, High Modulus Crystalline Thermoplastic Article Such as Fiber or Film", now abandoned; and
3. U.S. Ser. No. 359,975 of Harpell, Kavesh, Palley & Prevorsek, entitled, "Improved Ballistic-Resistant Article", now U.S. Pat. No. 4,403,012, issued Sept. 6, 1983.
4. U.S. Ser. No. 359,976 of Harpell, Kavesh, Palley & Prevorsek, entitled, "Coated Extended Chain Polyolefin Fiber", now abandoned.

Also related is an application of Harpell, Kavesh, Palley and Prevorsek entitled, "Producing Modified High Performance Polyolefin Fiber," Ser. No. 430,577, filed Sept. 20, 1982, now U.S. Pat. No. 4,455,273, issued June 19, 1984.

BACKGROUND OF THE INVENTION

The present invention relates to fabrics formed from ultrahigh tenacity and modulus fibers, and particularly to heat-shrinkable and heat-settable fabrics formed from ultrahigh tenacity and modulus polyolefin fibers, as well as to methods of heat-shrinking and heat-setting such fabrics.

Fabrics are conventionally produced by weaving, knitting or otherwise forming shrinkable fibers such as wool, silk, cotton, polyesters, acrylics and polyamides. After forming, the fabric is heated to a temperature below the melting point of the fiber (and typically above its minimum crystallization temperature) whereat the fiber shrinks slightly (e.g. 1–10%). The shrinking relieves strains caused by the forming (e.g. weaving) process, tightens the fabric, evens the bearing load of the fibers and improves the feel of the fabric. If the heating is applied with the fabric under stress (or strain), either of a stretching or deforming (e.g. creasing) nature, the fabric will also set in the shape which it assumes under the stress (or strain).

Fibers of ultrahigh tenacity (e.g. 20 g/denier or more) and modulus (e.g. 600 g/denier or more), such as polyaramids, graphite, boron and polybenzothiazole, have been used or proposed for a variety of applications including composites, ballistics protection, sails and puncture resistant articles of clothing. In some of these applications (e.g. sails and body armor), the fiber may take the form of a fabric. The known ultrahigh tenacity and modulus fibers do not heat-shrink or heat-set, however. The utility of a high performance fiber in fabric form would be enhanced if it could be shrunk or set, while substantially retaining the fiber properties. In addition to aesthetic advantages, a heat-shrunk or heat-set fabric could exhibit superior mechanical properties by the load-equalization, even if the individual fiber properties remained unchanged or declined sligtly. To achieve these benefits with polyaramid fibers, fabrics have been prepared with a shrinkable lower performance fiber as the woof yarn and the polyaramid as the warp yarn, or vice versa.

BRIEF DESCRIPTION OF THE INVENTION

It has been discovered that high performance stretched ultrahigh molecular weight polyolefin fibers and similar fibers containing polymeric additives can be heat-shrunk or heat-set in a controlled fashion with substantial retention of properties and that these properties can be employed in high performance fabrics made therefrom. Accordingly, the present invention includes a method for preparing fabrics which comprises the steps:

(a) forming a fabric from stretched fibers of tenacity at least about 20 g/denier and tensile modulus at least about 600 g/denier containing polyethylene of weight average molecular weight at least about 500,000, and (b) heating the fabric at a temperature between about 120° C. and about 145° C. sufficient and for a time sufficient for the fibers to shrink between about 1% and about 10% of their length in the fabric formed in step a.

The present invention also includes a method of preparing heat-set fabrics which comprises the steps:

(a) forming a fabric from stretched fibers of tenacity at least about 20 g/denier and tensile modulus at least about 600 g/denier containing polyethylene of weight average molecular weight at least about 500,000, and (b) heating the fabric under an applied stress (or strain) at a temperature between about 120° C. and about 145° C. sufficient and for a time sufficient to set the fabric in a shape assumed under the applied stress (or strain). The applied stress may be simple tension, a deformation such as a crease or a combination of tension and deformation. Alternatively, the fabric can be held to fixed dimensions and the stress caused by shrinkage.

The present invention also includes heat-shrunk or heat-set fabrics formed by either or both of the above methods.

The present invention further includes a method for preparing dimensionally stable, twisted multifilament yarns which comprises:

(a) twisting at least one strand of multifilament yarn having a tenacity at least about 20 g/denier and tensile modulus at least about 600 g/denier containing polyethylene of weight average molecular weight at least about 500,000, and (b) heating the twisted multifilament yarn to a temperature between about 100° C. and about 145° in the presence or absence of applied stress or strain for a time sufficient to set the yarn in twisted form.

The present invention also includes the dimensionally stable twisted multifilament yarn so prepared.

BRIEF DESCRIPTION OF THE DRAWING

The FIGURE schematically illustrates the basic process and the optional step of heat setting the yarn employed to form the fabric.

DETAILED DESCRIPTION OF THE INVENTION

The term "heat setting" is used herein as meaning subjecting a fiber (in fabric or yarn form) to a temperature-stress history to fix the fiber in a particular configuration. The term "heat-shrinking" is intended to mean a form of heat-setting in which little or no external stress or strain is applied to the fiber during heating. Other forms of heat setting include heating under deforming stress, heating while stretching and heating while restrained such that stress develops.

The fibers used in the fabrics and method of the present invention include the polyethylene fibers described in applications 359,019 and 359,020, referenced above, the disclosures of which are incorporated herein by reference. Briefly, fibers are formed by dissolving an ultrahigh molecular weight (at least 500,000, preferably at least 1,000,000) polyethylene in a high boiling solvent (e.g. paraffin oil) at a low concentration (e.g. 4–7%). The solution is spun and quenched to form first gel fibers, which are extracted with a volatile solvent (e.g. trichlorotrifluoroethane) to form second gel fibers, and dried to form xerogel fibers. One or more of the first gel fibers, second gel fibers and xerogel fibers are stretched in one or more stages, with the last stage preferably at a temperature of 120°–160° C. to form a fiber of tenacity at least 20 g/denier (preferably 30 g/denier) and modulus at least 600 g/denier (preferably at least 1000 g/denier and more preferably at least 1600 g/denier). Other characteristics of the fiber are melting point at least 147° C. (preferably at least 149° C.), porosity no more than 10% (preferably no more than 6%), creep value no more than 5% (preferably no more than 3%) when measured at 10% of breaking load for 50 days at 23° C. and elongation to break no more than 7%.

The fiber may contain polyethylene alone, or may contain various additives. One group of additives are the fillers (such as inorganic fibers) described in EPO Application No. 55001 of Stamicarbon B.V. (June 30, 1982). Another group of additives are lubricants, antioxidants, antistats, UV blocking agents and other common additives added in small amounts to polyethylene or to other conventional thermoplastics. A preferred group of additives are the polymeric additives described in a copending application U.S. Ser. No. 430,577 (now U.S. Pat. No. 4,455,273), the disclosure of which is incorporated herein by reference. Such polymeric additives include polyolefins (e.g. high and low density polyethylene) of molecular weight not greater than about 250,000, copolymers with a monoolefin as the primary monomer (including ethylene-vinyl acetate and ethyleneacrylic acid copolymers, EPDM rubbers), polyolefin graft copolymers, oxidized polyolefins and polyoxymethylenes. The polymeric additive may at some point be neutralized or hydrolyzed. Such fibers with polymeric additives are sometimes referred to herein as "polymer-modified fibers".

Such fibers may be formed in single filaments, or preferably as multifilament yarns as exemplified by Examples 487–551 of Ser. Nos. 359,019 (U.S. Pat. No. 4,413,110) and 359,020. Multiple yarns may be combined for stretching, as in the 16 filament yarns stretched as 48 or 64 filament yarns in Examples 543–551.

Other high tenacity and modulus polyethylene fibers may also be used in the method and fabric of the present invention, including the fibers of U.K. Applications 2,051,667 (1981) and 2,042,414 (1980), both of Stamicarbon. Also suitable are fibers drawn from supersaturated solutions as in U.S. Pat. No. 4,137,394 to Meihuizen et al. (1979) and allowed U.S. Ser. No. 225,288, filed Jan. 15, 1981 now U.S. Pat. No. 4,356,138, issued Oct. 26, 1982 (to which European Published Application No. 56875, published Aug. 4, 1982 corresponds).

The fibers may be coated with polyolefins (e.g. low or high density polyethylene) or copolymers (e.g. ethylene-acrylic acid copolymers) as described in aboverefenced application serial number 359,976, the disclosure of which is incorporated herein by reference. Such fibers are sometimes referred to hereafter as "polymer-coated fibers." Additionally, common fiber coatings such as processing aids and lubricants may be applied.

The fibers may be used as formed, or may be twisted in a manner conventionally used for silk, cotton, and other multfilament yarns subject to fibrillation. Based upon the heat settability of the present polyethylene fibers, the twisted yarns may be heat set at temperatures such as 100°–130° C., preferably a temperature lower than that used subsequently for heat-setting or heat-shrinking the fabric.

The fibers are then formed into fabrics (including nets) by any conventional process such as knitting, weaving, thermal or adhesive bonding such as used to produce non-woven fabrics or knotting. Various twists or crimps may be introduced into the yarn prior to forming the fabric. It is also contemplated that other fibers may be incorpoated with the high strength polyethylene fibers into the fabrics, as for example, by using polyethylene fibers in the warp direction and other fibers in the fill direction, or vice versa. Such other fibers may be conventional lower strength fibers such as polyester, polyamide, polypropylene or cotton, or may be other extremely high strength/modulus non-settable fibers such as polyaramids, graphite, boron or glass fibers. If the fabric is formed from high strength polyethylene fibers exclusively, the fiber used in one direction (e.g. the warp fiber) may be of a different tenacity, modulus, filament number, filament or total denier, twist and/or other characteristics than the fiber used in another direction (e.g. the fill fiber).

Once formed, the fabric is heat-set or heat-shrunk by heating to a controlled temperature in the range of 120°–145° C. for a controlled period of time under one of the following conditions. In a first mode, fabric may be heat-shrunk with little or no strain or tension applied, such that the fibers (and/or the fabric) shrinks in at least one direction between about 1 and about 10%, preferably between about 2 and 5%. The proper time for such shrinkage at a given temperature for a given fabric can be determined by routine experimentation based upon the teachings of the Examples below. In view of the failure of most high performance fibers to shrink at all, the present shrinking and setting processes provide unusual utility for high tenacity-high modulus polyethylene fibers. Conversely, the fact that many of the present fibers are stretched 10:1 or more (in the processes of Smith and Lemstra and of Kavesh and Prevorsek) might suggest that they should shrink excessively (since most fibers shrink more the higher the stretch ratio). The fact that shrinkage in the usable range of 1–10% can be obtained, even at 140° C. (above the 138° C. melting point of the base polymer and within 10° C. of the melting point of the fiber), is especially surprising.

In a second mode, the fabric may be heated with a creasing or other deforming stress (or strain) applied. Under such condition the crease or other deformation will be set into the fabric. In a third mode, the fabric can be held in one or both dimensions (e.g. in a frame or by tenter hooks) while heated to a temperature causative of shrinkage. Under such conditions, a stress will develop in the direction or directions in which the fabric is held constant, and the fabric will set. Similarly, a stretching force or a partial resistance to shrinkage may be applied in one or both directions.

In all cases, the heat shrinking or setting will permit the fabric to relieve, to a lesser or greater degree in various modes, the individual fiber stresses and nonuniformity of fiber load-bearing developed in the fabric-forming process. Additionally, either a planar fabric shape or a deformed fabric shape (e.g. a crease) can be set into the fabric. The heat-set or heat-shrunk fabric is expected to have similar or superior properties to the as-formed fabric in certain respects, e.g. tensile strength, modulus impact resistance and ballistic resistance. Other properties, such as lowered gas and liquid permeability and dimensional stability are expected to improve.

The fabrics prepared according to the present invention are especially useful in sails (including glider components), nets, filter cloths, tents (including floating roof members and inflatable buildings), industrial fabrics and articles of ballistic protection. The heat set twisted yarns of the present invention are particularly useful in forming fabrics, nets, composites and ropes. Fabrics and twisted yarns prepared from polymer-modified fibers or polymer-coated fibers may have advantageous properties for several of these applications because of the tendency of surface lower-melting polymer to soften, shrink and/or adhere to adjacent fibers, to matrices or to other surfaces upon heating (such as the heating used for shrinkage or setting).

EXAMPLE 1

Examples 1–4 Shrinkage of Once-Stretched Yarns

Four xerogel fibers yarns were prepared as in Examples 100–108 and 487–495 of U.S. Ser. No. 359,019 (now U.S. Pat. Nos. 4,413,110) and 359,020. All four were stretched at 140° C. in a heated tube (1.52 m or 5 feet in length) to produce fibers of 19–43 g/den tenacity and 640–1700 g/den tensile modulus. Samples of each fiber (7.9 mm in length) were then heated, without stress or strain, at a heating rate of 10° C./min in a PERKIN ELMER TMS-1 Thermal Mechanical Analyzer up to 120° C. or 140° C. By continuously measuring the fiber length, a percent shrinkage was determined. The results are displayed in Table 1.

TABLE 1

| Example | Fils | Tenacity | Modulus | Percent Shrinkage at 120° C. | Percent Shrinkage at 140° C. |
|---|---|---|---|---|---|
| 1 | 1 | 36 | 1280 | 1.1 | 2.4 |
| 2 | 1 | 36 | 1180 | 1.0 | 2.3 |
| 3 | 1 | 43 | 1700 | 0.4 | 1.0 |
| 4 | 16 | 19 | 640 | 1.0 | 4.4 |

All fibers shrank between 1 and 10% at both temperatures, except for the strongest material (Example 3) at 120° C.

Examples 5–11 Shrinkage of Wet-Wet Stretched Yarns

Seven yarns were spun as in Examples 503–516 of Ser. No. 359,019 (now U.S. Pat. No. 4,413,110) and 359,020 and then stretched twice as wet gel fibers. Thereafter the fibers were extracted with trichlorotrifluoroethane and dried. All stretching was conducted in the same heated tube, with all first-stage stretching at 120° C. and a stretch ratio of 12:1 in Examples 5–8, 6.45:1 in Examples 9 and 11 and 9:1 in Example 10. The second stage stretching was at the temperature and ratio indicated in Table 2. The tenacity and modulus of the stretched, extracted and dried fibers, and the percent shrinkage at 120° C. and 140° C. (determined as in Examples 1–4) are all displayed in Table 2.

TABLE 2

| Example | Second Stretch Temp | Second Stretch Ratio | Tenacity g/den | Modulus g/den | Percent Shrinkage At 120° C. | Percent Shrinkage At 140° C. |
|---|---|---|---|---|---|---|
| 5 | 131 | 1.75 | 29 | 1400 | 0.8 | 2.9 |
| 6 | 140 | 1.75 | 32 | 1370 | 0.8 | 2.9 |
| 7 | 150 | 2.25 | 31 | 1620 | 0.3 | 1.3 |
| 8 | 150 | 1.7 | 28 | 1250 | 0.7 | 2.6 |
| 9 | 150 | 2.25 | 30 | 1590 | 0.7 | 3.2 |
| 10 | 150 | 2.25 | 27 | 1510 | 0.8 | 3.8 |
| 11 | 150 | 1.5 | 29 | 1100 | 0.8 | 5.6 |

All fibers shrank between 1 and 10% at 140° C., but less than 1% at 120° C. Either longer times or temperature higher than 120° C. would be required to achieve significant shrinkage of these very high modulus fibers.

Examples 12–15 Shrinkage of Wet-Dry Stretched Fibers

Example 5–11 were repeated through the spinning and first stretching 12:1 at 120° C. The once-stretched fibers were then extracted with trichlorotrifluoroethane and dried. The dried fibers were then stretched at the temperatures and stretch ratios indicated in Table 3. The fiber properties and percent shrinkage (as measured in Examples 1–4) are also shown in Table 3.

TABLE 3

| Example | Second Stretch Temp | Second Stretch Ratio | Tenacity g/den | Modulus g/den | Percent Shrinkage At 120° C. | Percent Shrinkage At 140° C. |
|---|---|---|---|---|---|---|
| 12 | 131 | 1.5 | 26 | 1280 | 1.0 | 4.6 |
| 13 | 140 | 1.75 | 27 | 1240 | 1.0 | 2.0 |
| 14 | 150 | 1.87 | 35 | 2030 | 0.0 | 1.8 |
| 15 | 150 | 2.0 | 32 | 2305 | 0.6 | 1.4 |

All fibers shrank between 1 and 10% at 140° C., but only the lower modulus fibers (Examples 12 and 13) shrunk 1% at 120° C.

Examples 16–20 Shrinkage of Dry-Dry Stretched Fibers

Four fibers were spun, extracted and dried, using the same general procedure as in Examples 1–4. The xerogel (dried) fibers were all stretched once at 120° C. at stretch ratios of 10:1 in Examples 16–18, 6.5:1 in Example 19 and 10.5:1 in Example 20, and then at the temperatures and stretch ratios indicated in Table 4. The fiber properties and percent shrinkage (determined as in Examples 1–4) are displayed in Table 4.

TABLE 4

| Example | Second Stretch Temp | Second Stretch Ratio | Tenacity g/den | Modulus g/den | Percent Shrinkage At 120° C. | Percent Shrinkage At 140° C. |
|---|---|---|---|---|---|---|
| 16 | 130 | 1.75 | 23 | 1050 | 0.6 | 2.2 |
| 17 | 140 | 1.75 | 28 | 1130 | 0.6 | 1.6 |
| 18 | 140 | 2.0 | 24 | 1220 | 0.8 | 2.3 |
| 19 | 150 | 1.75 | 24 | 1180 | 0.6 | 1.9 |
| 20 | 150 | 1.9 | 25 | 1700 | 0.8 | 1.8 |

All fibers shrunk between 1 and 10% at 140° C., but not at 120° C.

Comparison of Examples 1–20

The closest correlation noted in Examples 1–20 was between 140° C. shrinkage and yarn modulus (inverse relation). It should be apparent from these examples that stretching conditions can be chosen to achieve excellent fiber properties, and that shrinkage conditions (time and temperature) can be chosen to achieve desired percentages of shrinkage leading to heat-shrunk fabrics or heat-set fabrics.

EXAMPLE 21

In like manner, three of the fibers of U.S. Ser. Nos. 359,019 and 359,020 were heated at 120° C. and 140° C. The results are displayed in Table 5.

TABLE 5

| Example | Tenacity g/den | Modulus g/den | Percent Shrinkage At 120° C. | Percent Shrinkage At 140° C. |
|---|---|---|---|---|
| 71 | 38 | 1460 | 15 | 32 |
| 548 | 32 | 2300 | 0.6 | 1.6 |
| 550 | 35 | 203 | 0.8 | 1.8 |

EXAMPLES 22–25

The fibers used in the following Examples were prepared in accordance with the procedures of U.S. Ser. Nos. 359,019 (now U.S. Pat. No. 4,413,110) and 359,020 and had the following properties.

TABLE 6

| FIBER | DENIER | FILA-MENTS | TENACITY | MODULUS |
|---|---|---|---|---|
| A | 887 | 96 | 27 | 1098 |
| B | 769 | 144 | 29.6 | 1343 |
| C | 870 | 48 | 14.8 | 516 |
| D | 887 | 96 | 27 | 1096 |
| E | 769 | 144 | 29.6 | 1343 |
| F | 647 | 128 | 32.1 | 1409 |
| G | 610 | 96 | 33.3 | 1403 |
| H | 588 | 123 | 32 | 1443 |
| I | 319 | 48 | 27 | 1662 |
| J | 380 | 96 | 28.1 | 1386 |
| K | 553 | 96 | 27.5 | 1270 |
| L | 385 | 64 | 30 | 1624 |
| M | 434 | 64 | 29 | 1507 |
| N | 451 | 96 | 29 | 1636 |
| O | 449 | 96 | 33 | 1502 |
| P | 403 | 64 | 30 | 1419 |
| Q | 508 | 48 | 30 | 1330 |
| R | 624 | 96 | 31 | 1300 |
| S | 274 | 32 | 32 | 1370 |

Fibers A and B were both prepared from 21.5 dL/g IV polyethylene at concentrations of 8% and 6%, respectively, in paraffin oil. Both were spun at 220° C. through 16 hole die (0.030 inches or 0.762 mm diameter) at rates of 2 and 1 $cm^3$/min, respectively, and take-up speeds of 4.98 and 3.4, respectively. Fiber A was stretched 2:1 in-line at room temperature, 5.3:1 at 120° C. and 2.0:1 at 150° C. using feed speeds of 4.98, 1.0 and 2.0 m/min for the three stages. Fiber B was stretched 10:1 at 120° C. and 2.7:1 at 150° C. using feed speeds of 0.35 and 1.0 m/min, respectively. Fibers A and B were extracted with trichlorotrifluoroethane after stretching to remove residual paraffin oil, and then dried. Fiber C was spun at 220° C. from a 6–7% solution of a 17.5 dL/g IV polyethylene through a 16-hole die with 0.040 inch (1.016 mm) diameter holes, at a spin rate of 2.86 $cm^3$/min and a take up of 4.1–4.9 m/min. The fiber was stretched after extraction and drying as a 48 filament bundle 15:1 at 140° C. with a 0.25 m/min feed speed.

TABLE 7

| Fiber | Stretch Ratios Room Temperature | Stretch Ratios 120° C. | Stretch Ratios 150° C. |
|---|---|---|---|
| D | 2.0 | 5.25 | 2.0 |
| E | — | 10 | 2.7 |
| F | — | 10.3 | 2.5 |
| G | — | 10 | 2.5 |
| H | — | 10.3 | 2.75 |
| I | — | 6.4 | 2.85 |
| J | — | 11 | 2.5 |
| K | — | 9 | 2.5 |
| L | 2.0 | 6.45 | 2.25 |
| M | 2.0 | 6.45 | 2.25 |
| N | — | 12.5 | 2.5 |
| O | — | 10.3 | 2.75 |
| P | 2.5 | 6.5 | 1.75 |
| Q | 4.0 | 6.0 | 2.0 |
| R | 2.0 | 6.7 | 1.9 |
| S | 2.0 | 5.5 | 2.25 |

EXAMPLE 22

A fabric was woven using a Leclerc Dorothy craft loom having 12 warp ends per inch (4.7 ends/cm). The warp yarn (Fiber A in Table 6) was twisted to have approximately 1 twist per inch (0.4 twists/cm). Fill yarn (Fiber B in Table 6) had the same amount of twists. Panels (8" by 4") (20.3 cm by 10.2 cm) of the fabric were cut out using a sharp wood-burning tool. (This technique yields sharp edges which do not tend to unravel.) Certain of the panels were clamped between metal picture frames and placed in an air circulation oven at the desired temperature for 10 minutes. This procedure caused the fabric to become tight in the frame. One inch (2.25 cm) strips were cut from these fabrics in the fill direction and subsequently pulled on an Instron machine using a 4 inch (9 cm) gauze length at a cross head speed of 2 inches/min (4.5 cm/min). From comparison of the initial force-displacement for fabric before and after heat-setting, it was found that heat setting improved the apparent modulus of the fabric, as shown below:

| Heat Set Temperature (°C.) | Relative Apparent Modulus |
|---|---|
| None | 1.0 |
| 135 | 1.23 |
| 139 | 1.15 |

When the force reached 500 pounds (227 kg), the fabric began to slip from the grips.

EXAMPLE 23

Fiber C (see Table 6) was woven on a Peacock 12 inch (30.5 cm) craft loom. Fabric was prepared having 8 warp yarns/in (3.15 warp yarns/cm) and approximately 45 yarns/in (17.7 yarns/cm) in the fill direction.

A rectangular piece of fabric 8.5 cm in length in the fill direction and 9.0 cm in length in the warp direction was placed in an air oven at 135° C. for five minutes. The fabric contracted 3.5% in the fill direction and by 2.2% in the warp direction. This fabric became noticeably more stable to deformation force applied at a 45° angle to the warp and fill direction.

The fabric was easily cut by applying a hot sharp edged wood burning implement to the fabric to give sharp, non-fraying edges. Attempts to cut the fabric with conventional techniques produced uneven edges which were easily frayed.

A circular piece of this untreated woven fabric, 7.5 cm in diameter, was exposed to 138° C. in an air oven for 30 minutes. Dimensions were reduced by 15% in the warp direction and by 39% in the fill direction.

EXAMPLE 24

A number of other fabrics have been prepared using a Leclerc Dorothy craft loom.

Fabric 1

All yarns were twisted on a spinning wheel and had approximately 1 turn per inch (0.4 turns/cm). Fabric was prepared 8½" (21.6 cm) wide by 16" (40.6 cm) long using 12 warp ends per inch (4.2 ends/cm) of yarn D. In the fill direction, 12" (30 cm) of yarn E was used and 4 inches (10 cm) of yarn F. to give a fabric having an areal density of 0.297 kg/m².

Fabric 2

All yarns were twisted on a spinning wheel and had approximately 1 turn per inch (0.4 turns/cm). Fabric ws prepared 8½ (21.6 cm) wide by 8½ (21.6 cm) long using 12 warp ends per inch (4.7 end/cm) of yarn D. Yarn F was used for 5" (12.7 cm) of the fill yarn. Yarn G was used for 37½" (8.9 cm) inches in the fill direction.

Fabric 3

In order to obtain yarn having denier in the range of 800–900 it was necessary to combine two different yarns to produce a single twisted yarn. The combined twisted yarn was prepared by feeding the two different non-twisted yarns simultaneously to a spinning wheel and producing a twist of approximately 1 turn per inch (0.4 turns/cm) in the combined yarn. The twisted yarn was much easier to weave than the untwisted precursors. A continuous fabric 8.5 inches wide (21.6 cm) and 52 inches (132 cm) long was woven, using a plain weave and weighed 78 g, corresponding to areal density of 0.274 kg/m² (8 oz/square yard). Fabric was woven on a Leclerc Dorothy craft loom using 12 warp ends per inch (4.7 ends/cm) and approximately 56 yarns/in (12 yarns/cm) in the fill direction.

The warp ends for 6 inches (15.2 cm) of warp consisted of the combined yarn formed from yarn H and I, and for 3 inches (7.6 cm) of warp from yarns J and K. The fabric pulled in on weaving to an overall width of 8½" (21.6 cm). Fill yarns were as follows: The first 11½" (29 cm) used combined yarn from yarns J and K. The next 30½" (77.5 cm) were prepared using combined yarn L and M and the final 10 inches were prepared using combined yarn N and O.

Fabric 4

In order to obtain yarn having denier of approximately 900 it was necessary to combine two different yarns to produce a single twisted yarn. The combined twisted yarn was prepared by feeding the two different non-twisted yarns simultaneously to a spinning wheel and producing a twist of approximately 0.416 turns/inch (0.16 turns/cm) in the combined yarn. A continuous fabric 9.0 inches wide (22.9 cm) and 441/2 inches (113 cm) long was woven having an areal density of approximately 0.22 kg/m². Fabric was woven on a Leclerc Dorothy craft loom using 24 warp ends/in (9.5 warp ends/cm) and having approximately 24 fill ends per inch (9.5 fill ends/cm).

The warp ends for 6 inches (15.2 cm) of the warp consisted of the combined yarn P and Q, and for 3 inches (7.6 cm) consisted of the yarn formed by combining yarns R & S. The entire fill yarn consisted of the yarn prepared by combining yarns R and S.

Fabric 5

This commercial Kevlar® 29 ballistic fabric was obtained from Clark-Schwebb Fiber Glass Corp. (Style 713, Finish CS-800) and contained 32 ends/in of untwisted yarn in both the warp and fill directions. The areal density of this fabric was 0.286 kg/cm³.

EXAMPLE 25

Ballistic Evaluation of Fabrics

Fabrics were held in an aluminum holder consisting of 4 in square (10 cm) aluminum block, ½ in (1.2 cm) thick having a 3 in (7.6 cm) diameter circle in the center. At the center of one side a 0.5 cm diameter hole was drilled and connected the large circle via a slit, and on the opposite side of the circle a 0.5 cm slit was cut to the edge of the square. A screw arrangement allowed the slit to be closed down. Fabric was stretched over appropriate size aluminum rings and the square holder tightened around the fabric. Projectiles were fired normal to the fabric surface and their velocity was measured before impact and after penetration of the fabric. Two types of projectiles were used:

(1) 22 caliber fragments—weight 17 gms (1.1 grams) Military Specification MIL-P-46593A (ORD) -Projectile Calibers 0.22, 0.30, 0.50 and 20 mm Fragment Simulating.

(2) 22 caliber solid lead bullets—weight 40 grains (2.5 gms)

Fabric was cut into 4 in by 4 in squares (10.2 cm squares). The individual squares were weighted and the areal density was calculated. The desired number of layers were placed in the holder for ballistic testing.

Certain of the fabric squares were heat set at 138° C. between two picture frames 4 in (10.2 cm) square outside dimension and a 3 in (7.6 cm) inside dimension. Pressure was applied using C-clamps on the picture frame.

The average volume for energy absorption using two layers of Kevlar 29 was 35.5 J.m²/kg, which was lower than that obtained for all of the polyethylene fabrics tested. The average value for energy absorption using 2 layers of Fabric 4 was 49.4 J.m²/kg before heat setting and 54.7 after heat setting. The energy absorption of Fabric 3, using two layers of fabric, was 45.5 J.m²/kg before heat setting and 49.2 J.m²/kg after heat setting.

Against lead bullets, the average value for energy absorption for 2 layers of Fabric 4 was 7.5 J.m²/kg before heat setting and increased to 16.6 J.m²/kg after heat setting. Similarly, the average value of energy absorption increased from 5.9 to 11.0 J.m²/kg for Fabric 3. Based upon mode of failure (whole loops being pulled out), the relatively low values for all polyethylene fabrics against bullets suggest that different weaving techniques might realize the full potential of the fibers (as with fragments).

Nevertheless, all ballistic results indicate that heat setting increases the energy absorption of the polyethylene fabrics.

EXAMPLE 26

Four fibers were prepared containing 10 or 30% of one of the following polymeric additions:

EAA5.5 - an ethylene-acrylic acid copolymer having 5.5% acrylic acid on a weight basis (sold by Dow Chemical Company as EAA-455)

EAA9.0 - an ethylene-acrylic acid copolymer having 9.0% acrylic acid on a weight basis LDPE - a low density polyethylene (sold by Dow Chemical as PE122) having a melt index of 0.25 dg/min and density of 920 kg/m$^3$ The preparation of these fibers are described in detail in application Ser. No. 430,577 (now U.S. Pat. No. 4,455,273) as Examples 4, 6, 11 and 12, the description of which is incorporated herein by reference. Briefly all fibers were spun as 6 weight percent solution of UHMW polyethylene (IV 23), mixed and spun at 220° C. using 16 0.75 mm hole diameters, 1 cm$^3$/min-filament spin rate, 1.1:1 die draw and 2:1 in-line room temperature draw. After extraction, drying and combining into 32, 86 or 96 filament yarns, stretching was performed at 120° C. and 150° C. at the indicated ratios:

| Example | Additive | | Stretch Ratio 120° C. | 150° C. | Overall | Filament No | Denier/Fil |
|---|---|---|---|---|---|---|---|
| 26-4 | EAA5.5 | 10% | 7.4 | 2.0 | 30 | 32 | 12.2 |
| 26-6 | LDPE | 10% | 7.25 | 2.0 | 29 | 96 | 5.8 |
| 26-11 | EAA9.0 | 10% | 7.75 | 2.0 | 31 | 80 | 6.4 |
| 26-12 | EAA5.5 | 30% | 5.0 | 1.9 | 22 | 80 | 9.5 |

Mechanical properties, melting points (in some cases) and shrinkage (as determined in Examples 1–4, above) were then measured as displayed below:

| Example | Tenacity (g/den) | Modulus (g/den) | Melting Point (°C.) | Shrinkage At 120° C. | 140° C. |
|---|---|---|---|---|---|
| 26-4 | 30 | 1420 | 146 | 0.4 | 1.8 |
| 26-6 | 32 | 1380 | 144 | 0.4 | 2.5 |
| 26-11 | 33 | 1320 | — | 0.4 | 2.4 |
| 26-12 | 17 | 710 | 143* | 0.6 | 5.7 |

*lower melting temperature at 95° C. was observed

These results show general agreement in shrinkage behavior for the polymer-modified fibers as compared to the unmodified fibers tested in Examples 1–21, above. While the fibers of 26–12 show a tenacity (17 g/den) below that contemplated for the present invention, other fibers of the same composition have been prepared (Examples 13–16 of Ser. No. 430,577 (now U.S. Pat. No. 4,455,273) with tenacities in the range of 20–25 g/den of 16, 48 and 64 filament yarn.

It is believed, based on the controlled shrinkage found for these polymer-modified fibers, that they will perform well in heat-set (including heat-shrunk) fabrics and twisted multifilament yarns.

EXAMPLE 26

Yarns P and Q (see Table 1, above) were combined to produce untwisted yarn PQ. A first portion of yarn PQ was twisted 0.42 turns per inch (0.17 turns per centimeter) and is hereafter designated PQ-0.17. A second portion of yarn PQ was twisted 0.83 turns per inch (0.32 turns per centimeter) and is hereafter designated PQ-0.32. A third portion of yarn PQ was tested as is.

A portion (200 cm in length) of each yarn tested was held at constant length and heat set in an air circulating oven at 138° C. for 7 minutes. Yarn PQ-0.32 before heat setting kinked in the absence of tension. After heat setting, this tendency disappeared.

Samples of the three yarns before heat setting (PQ, PQ-0.17 and PQ-0.32) and of the three heat set yarns were tested for tensile properties on an Instron tensile testing machine. The results were as follows:

| Yarn | Heat-set | Tenacity (g/den) | Modulus* (g/den) | Elongation (%) |
|---|---|---|---|---|
| PQ | No | 28.9 | 430 | 3.2 |
| PQ | Yes | 28.5 | 755 | 3.3 |
| PQ-0.17 | No | 22.4 | 217 | 3.8 |
| PQ-0.17 | Yes | 24.8 | 492 | 3.8 |
| PQ-0.32 | No | 22.5 | 147 | 5.1 |
| PQ-0.32 | Yes | 23.5 | 366 | 4.5 |

*The modulus indicated a secant modulus obtained from the stress-strain curve, using the beginning of the curve and the point where the force became 5 pounds (2.27 kg).

Comparing the six stress-strain curves, all three heat-set yarns showed force increasing linearly immediately in stretching. Both twisted, unset yarns (and the untwisted yarn PQ) showed an upward curvature in the initial portion of the stress-strain curve.

We claim:

1. A method for preparing fabrics which comprises the steps:

(a) forming a fabric from stretched fibers of tenacity at least about 20 g/denier and tensile modulus at least about 600 g/denier containing polyethylene of weight average molecular weight at least about 500,000, and (b) heating the fabric at a temperature between about 120° C. and about 145° C. sufficient and for a time sufficient for the fibers to shrink between about 1% and about 10% of their length in the fabric formed in step a.

2. The method of claim 1 wherein said polyethylene is of weight average molecular weight at least 1,000,000.

3. The method of claim 2 wherein said fibers have a tenacity of at least about 30 g/denier and a tensile modulus at least about 1000 g/denier.

4. The method of claim 3 wherein said fibers have a tensile modulus of at least about 1600 g/denier.

5. The method of claim 1 wherein step (b) is performed at a temperature and for a period of time sufficient for the fibers to shrink between about 2% and about 5%.

6. The method of claim 1 wherein said forming step (a) includes knitting.

7. The method of claim 1 wherein said forming step (a) includes weaving.

8. The method of claim 1 wherein said fibers are twisted multifilament yarns.

9. The method of claim 8 wherein the twisted multifilament yarn is heat set at a temperature between 100° C. and 130° C. prior to forming the fabric, and the temperature of said heating step (b) is higher than the temperature at which the twisted multifilament yarn is heat set.

10. A heat-shrunk fabric produced by the method of claim 1.

* * * * *